US005121697A

United States Patent [19]

Baum et al.

[11] Patent Number: 5,121,697

[45] Date of Patent: Jun. 16, 1992

[54] FLIP TOP TABLE

[75] Inventors: Elliott W. Baum, Maryland Heights; Alan Berkowitz, Clayton; Lucian Chirea, St. Louis, all of Mo.

[73] Assignee: Berco Industries, St. Louis, Mo.

[21] Appl. No.: 735,848

[22] Filed: Jul. 25, 1991

[51] Int. Cl.[5] ..... A47B 3/00

[52] U.S. Cl. ..... 108/124; 108/150

[58] Field of Search ..... 108/115, 150, 124, 1, 108/4, 6, 8, 132; 248/432, 166; 16/232, 257, 321

[56] References Cited

U.S. PATENT DOCUMENTS

| | | | |
|---|---|---|---|
| 2,978,895 | 4/1961 | Heisler | 108/15 R |
| 3,641,946 | 2/1972 | Channay | 108/6 |
| 3,993,004 | 11/1976 | Acme | 108/150 X |
| 4,112,855 | 9/1978 | Colby | 108/115 X |
| 4,643,105 | 2/1987 | Baum | 108/4 X |
| 4,986,195 | 1/1991 | Diffrient | 108/1 X |

FOREIGN PATENT DOCUMENTS

| | | | |
|---|---|---|---|
| 264171 | 1/1966 | Australia | 108/115 |
| 702 | of 1895 | United Kingdom | 108/115 |

*Primary Examiner*—José V. Chen

*Attorney, Agent, or Firm*—Paul M. Denk

[57] ABSTRACT

A flip top table includes a table surface which is hingedly connected to a pedestal leg so that the table surface may be pivoted between a generally vertical storage position and a generally horizontal use position. The hinge which connects the table surface to the pedestal leg includes a lock mechanism which holds the table surface down when in its horizontal and usable position, a release which releases the lock and a latch or arm which will prevent the table surface from falling when it is in its vertical storage position.

8 Claims, 4 Drawing Sheets

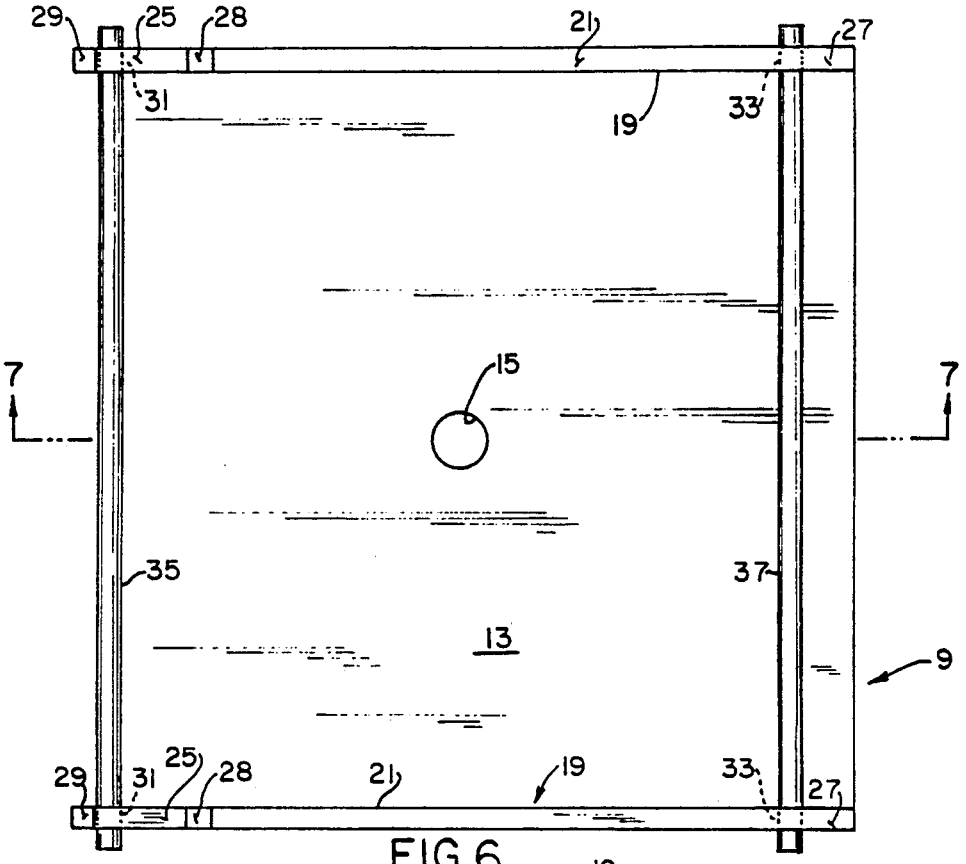
FIG.6.
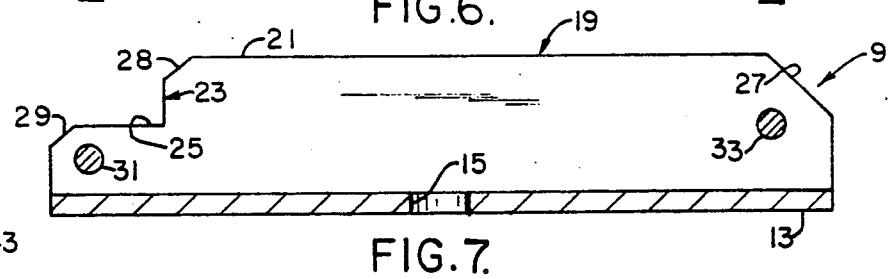
FIG.7.
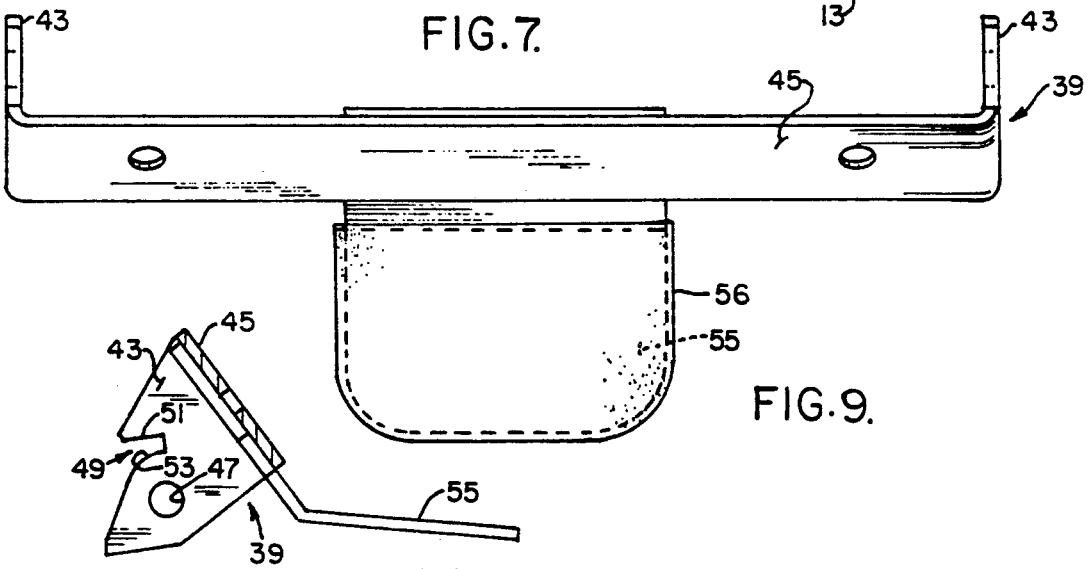
FIG.9.
FIG.8.

FLIP TOP TABLE

BACKGROUND OF THE INVENTION

This invention relates to tables and in particular, to tables with surfaces which may be manipulated between use and storage positions.

Space saving in commercial and institutional settings has always been a concern. While it may be desirable within a dining or conference setting to have a plurality of tables arranged throughout a hall for accommodating the seating of participants, frequently it becomes desirable or necessary to remove and rapidly clear the room of its disposed furniture. Hence, it has long been the desire to create tables that not only are attractive from an aesthetic standpoint when used, but which can also be easily removed if that becomes necessary.

For example, a collapsible table, or one which has foldable legs, has always been of value to the trade, but such tables are quite weak in structure, and have a tendency to be rather unstable during usage, usually to the owner's dissatisfaction.

Prior inventors have attempted to alleviate this problem, but yet provide a table that is both structurally stable and asthetically pleasing. Tables of this nature generally have been designed embodying the concept of providing some foldable feature to its top, so that it may be either removed from its supporting post, or perhaps tilted in relationship thereto. When arranged in the tilted position, the width of the entire table structure becomes substantially reduced so that a plurality of such tables can be stacked one against the other. Thus, many tables can be stored in a minimum of space.

Examples of the aforesaid type of table construction is shown in the United States patent to Alme, U.S. Pat. No. 3,993,004. As disclosed therein, the table post incorporates a mechanism or assembly that permits pivoting of its table top between the horizontal and into a substantially vertical position. The Alme table however, does not provide a mechanism for preventing the table top from falling when it is in its upright position. Rather the table surface pivots past the vertical and relies on gravity to maintain the table in its upright position. Another embodiment is shown in the U.S. Pat. No. 4,643,105, to the same inventor as shown herein, upon a table top support. This earlier patent is owned by a common assignee herein.

SUMMARY OF THE INVENTION

It is the principal object of this invention to provide a releasable table top support wherein it firmly holds and secures its table top in place upon the supporting column during table use, but likewise affords pivoting, under conditions that assure the retention of the table top as pivoted in place during such action, so as to prevent an untimely and undesired loosening or dropping of the table top while being tilted into its nonoperative, vertical and storage position.

Another object of this invention is to provide a table top support which is cast of structural steel or cast iron, and therefore has significant structural integrity for providing a firm mounting of the table top securely upon its columnar support.

Another object of this invention is to provide a mechanism which will prevent unwanted pivoting of the table surface from a level position to a storage position.

These and other objects may become more apparent to those skilled in the art upon reviewing the summary of this invention, and upon undertaking a study of the description of its preferred embodiment in view of the drawings.

In accordance with the invention generally stated, there is provided a flip-top table which includes a table surface, a pedestal, and a hinge which hingedly connects the table surface to the pedestal so that the table surface can be moved between a vertical storage position and a horizontal use position. The hinge comprises a bottom plate connected to the top of the pedestal and a top plate connected to the underside of the table surface. The top plate is pivotally connected to the bottom plate. A locking mechanism is provided to lock the top and bottom plates together when the table surface is in its horizontal use position. A release is provided to release the locking mechanism so that the table surface may be moved to its vertical storing position.

A catch for maintaining the table surface in its vertical storing position is also provided. The catch comprises an arm pivotally connected to the top plate to be generally parallel with the top plate when the table surface is in a vertical position. The arm extends between the top plate and the bottom plate to prevent the top plate, and hence the table surface, from pivoting toward its horizontal position when the table surface is in its vertical position.

The locking mechanism includes a generally "U" shaped bar having side legs and a cross member. The bar is pivotally connected to the bottom plate at a forward portion. Each leg has a slot therein which receives a horizontal portion of the rectangular tube. The bar is biased to pivot inwardly toward a rear of the bottom plate.

The release includes a tab on the cross member, which, when pressed will cause the bar to pivot outwardly allowing the leg slots to release the rectangular stop tube. The tab is preferably covered with a protective covering.

The top and bottom plates are kept in a generally parallel relationship when the table is in its horizontal position by the interaction of a stop on the top plate with a wall surface on the lower plate. More specifically, side walls extend upwardly from the bottom plate. Each side wall includes a step at a forward end thereof which defines a surface parallel and coplanar with, but arranged below, the top of said side walls. The stop on the upper plate sits on the stop surface when the table surface is in its horizontal position. The stop is sized and shaped to place the top and bottom plates in the generally parallel relationship. The stop comprises an open rectangular tube.

BRIEF DESCRIPTION OF THE DRAWINGS

In the drawings.

FIG. 6 is a bottom plan view of the bottom plate of the hinge mechanism;

FIG. 7 is a cross-sectional view of the bottom plate taken along line 7—7 of FIG. 6

FIG. 8 is a side-elevational view of a locking bar with a release handle thereon;

FIG. 9 is an isometric view of the locking bar and release handle;

DESCRIPTION OF THE PREFERRED EMBODIMENT

Figure 1:
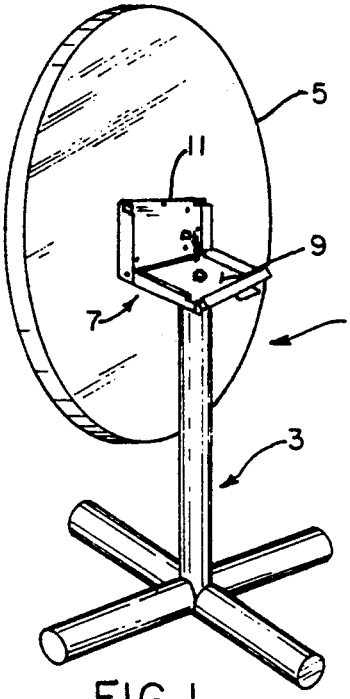
FIG. 1 is a perspective view of a flip top table in an upright and storage position.

Referring now to FIG. 1, reference numeral 1 represents a flip top table having a pedestal 3, a table top 5, and a hinge mechanism 7 which pivotally connects the table to the pedestal so that it may be pivoted between a vertical storage position and a horizontal use position. Hinge mechanism 7 includes a lower plate 9 and an upper plate 11.

Figure 2:
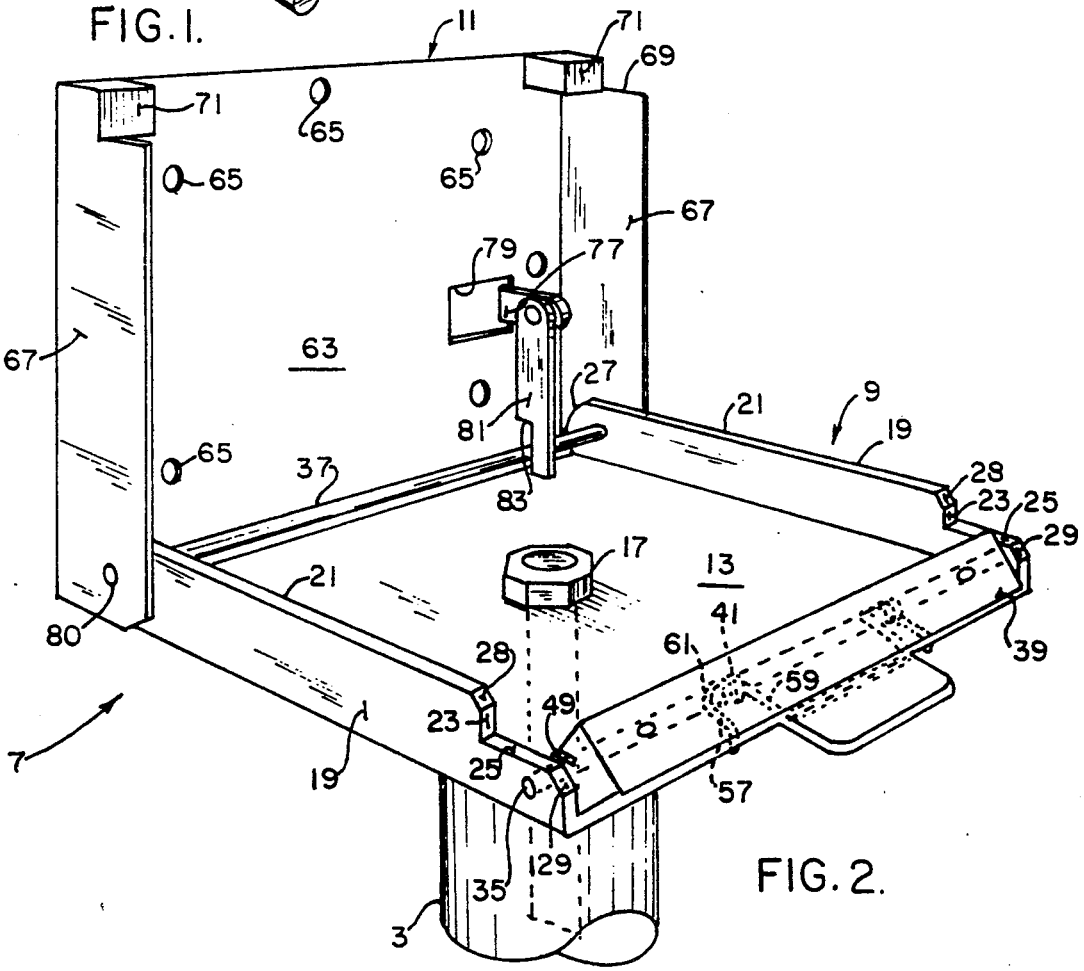
FIG. 2 is an enlarged view of a hinge mechanism used to enable the pivoting of the table's top.

As seen in FIGS. 2, 6, and 7, lower plate 9 includes a base 13 having a central opening 15. Opening 15 allows for base 13 to be secured to pedestal 3 by a bolt 17 which is threadedly received in pedestal 3. A wall 19 extends upwardly along opposite sides of base 13. Walls 19 include an upper surface 21 which extends from the back to approximately the front of the hinge 7. Approximately 85% along the length of the wall, a step 23 drops the wall to a lower surface 25. All corners are beveled, as at 27, 28, and 29. Each wall has a forward opening 31 and a rear opening 33. Aperture 31 is below lower surface 25; opening 33 is below the intersection of surfaces 21 and 27. Opening 33 is raised slightly above opening 31, having its center at about the same height as surface 25. Openings 31 and 33 receive a forward axle 35 and a rear axle 37, respectively.

Forward axle 35 carries a flip top latch 39 and a double torsion spring 41. (FIGS. 2, 8, and 9) Latch 39 includes a pair of side legs 43 and a cross member 45 therebetween. Legs 43 each have a hole 47 therethrough which allows latch 39 to pivot upon axle 35. Legs 43 also include a slot 49 having a flat upper surface 51, and a lower surface 53. Surface 53 curves (FIG. 8) or slants (FIG. 10) away from upper surface 51. A tab 55 extends outwardly from cross member 45. A covering 56 preferably encloses tab 55. Covering 56 is preferably made of a plastisol or other polymer A spring 41 is provided upon the axle or shaft 35. This spring 41 includes a first leg 57 and a second leg 59 which are joined by a resilient coil section 61. (FIG. 2) The spring is positioned to be between the latch cross member 45 and the bottom plate base 13 to bias the latch upwardly. In its normal biased position notch 49 is parallel with lower surface 25 as can be seen in FIG. 2.

Figure 4:
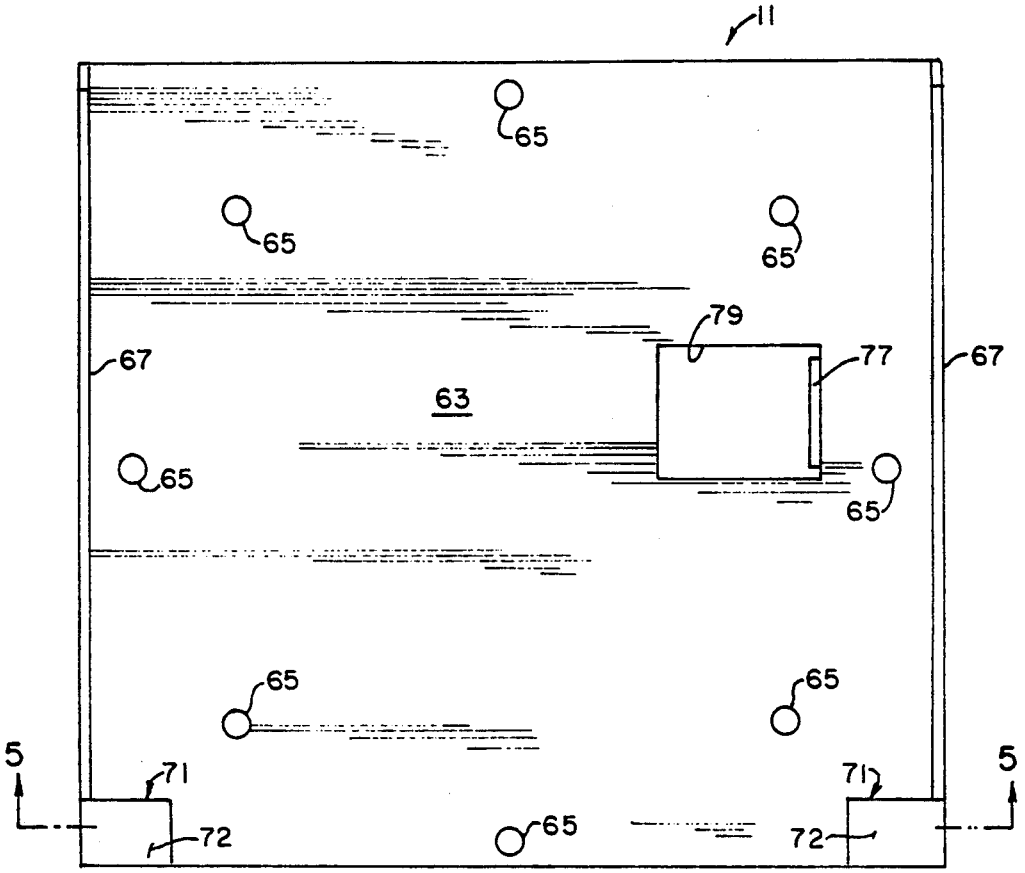
FIG. 4 is a bottom plan view of a top plate of the hinge mechanism.
Figure 5:
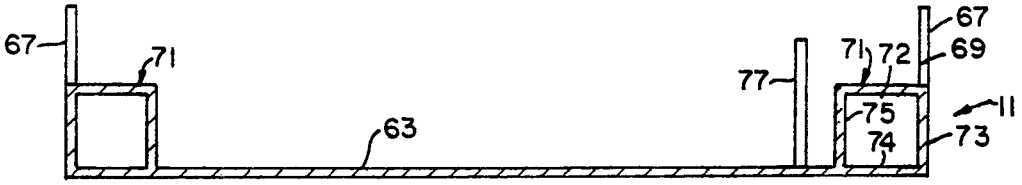
FIG. 5 is a cross-sectional view of the top plate taken along line 5—5 of FIG. 4.

Turning to FIGS. 4 and 5, the top plate 11 includes a base 63 having a plurality of screw holes 65 therein which allows it to be connected to table surface 5 using screws or other fasteners. As can be seen in FIG. 4, and for stability purposes, screw holes 65 are preferably arranged in a circular pattern. A skirt 67 extends along opposite sides of base 63. Angle brackets 68 may be secured to each skirt 67 so that a larger table surface may be secured to top plate 11. A step 69 is formed at the forward portion of each skirt 67. As can best be seen in FIG. 5, at step 69, an open ended box 71 is integrally formed having sides 72, 73, 74, and 75, as noted.

Figure 3:
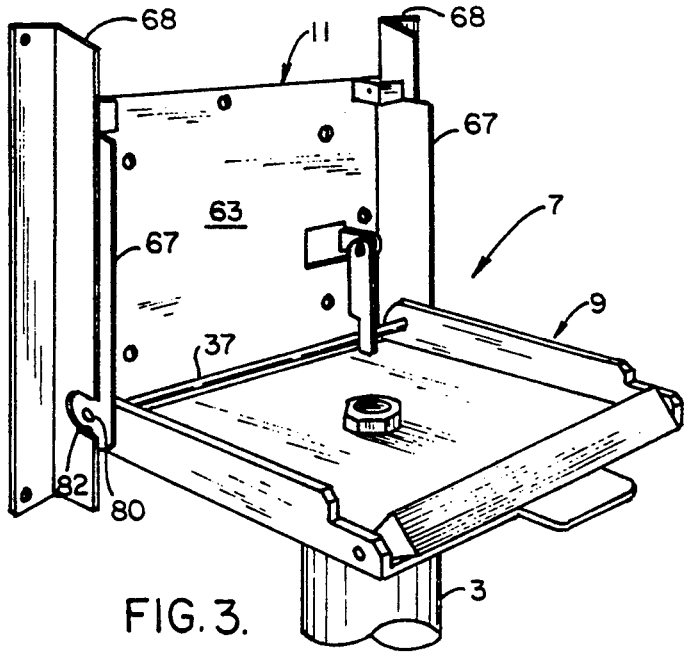
FIG. 3 is a view similar to FIG. 2 showing the hinge mechanism with angle brackets.
Figure 11:
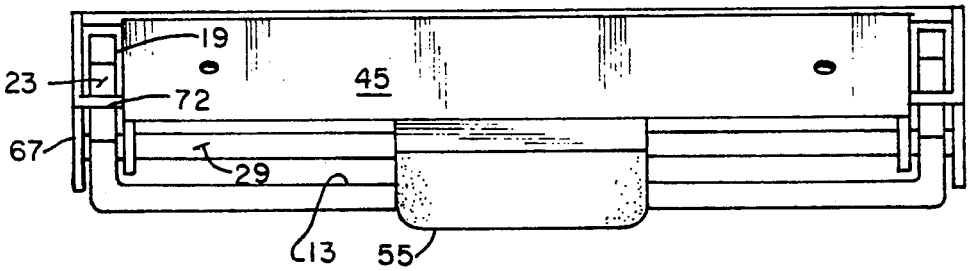
FIG. 11 is a front elevational view of FIG. 12
Figure 12:
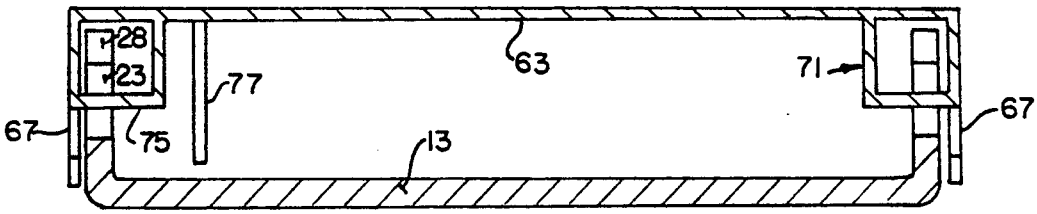
FIG. 12 is a cross-sectional view of the top and bottom plates taken along line 12—12 of FIG. 10.

Skirts 67 each have an aperture 80 at the rear thereof through which rear axle or shaft 37 extends to pivotally connect top plate 11 to bottom plate 9. Top plate 11 is slightly wider then bottom plate 9, as can be seen, so that skirts 67 sandwich walls 19, and are arranged in proximity therewith, as can be seen in FIGS. 2, 11, and 12. Angles 68 preferably have semicircular cutouts formed near a rear portion thereof to expose opening 80 of top plate 11. See FIG. 3.

A finger 77 extends perpendicularly from base 63 from an opening 79 formed therein. Finger 77 is integrally formed from the cutout which defines opening 79. When three sides of opening 79 are formed, the central tab which results is bent inwardly to form finger 77.

A stop arm 81 is pivotally connected to finger 77. When top plate 11 is in its raised position, stop arm 81 is generally parallel thereto and in contact with bottom plate base 13. Thus, top plate 13 and table surface 5 lean on arm 81 to be supported in the generally vertical position by stop arm 81. As can be seen, stop arm 81 is notched, as at 83, which may even be cut arcuately, to function as a holding catch, so that it may be positioned more or less over rear axle 37. To lower table surface 5 to its horizontal position, surface 5 is pushed back slightly, moving stop arm 81 off of bottom plate base 13. Arm 81 is then pivoted forwardly, towards front axle 35, to clear the catch, and surface 5 may then be lowered to its usable position.

When top plate 11 is lowered to its horizontal position, so that table surface 5 may be applied, the bottom side 74 of box 71 rests on bottom plate wall surface 25. Sides 73 and 75 of box 71 are of sufficient height so that top plate base 63 is generally parallel to bottom plate base 13. This will guarantee that the table surface 5 is generally level.

Figure 10:
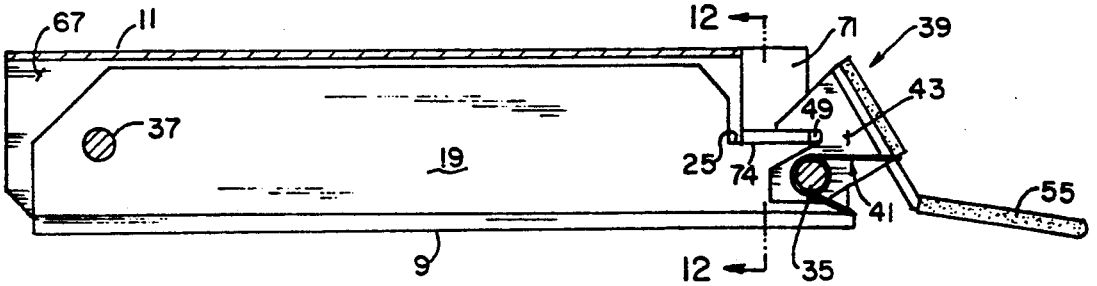
FIG. 10 is a side elevational view of the hinge mechanism showing the interaction of the top and bottom plates and the locking bar.

As can be seen in FIG. 10, when top plate 11 is arranged horizontally and in its usable position, side 74 of formed box 71 is received in slot 49 of latch 39 to prevent table surface 5 from pivoting upwardly during use. Because latch 39 is normally biased in a locking position by means of spring 41, table surface 5 cannot be raised unless the tab 55 of latch 43 is depressed to pivot latch 39 around axle 35 so that box wall 74 will clear and be released from latching slot 49. As can be seen in FIGS. 8 and 10, slot top surface 51 does not extend as far as the slot lower surface 53. Thus, when tab 55 is pressed to pivot latch 39, slot top surface 51 is moved out of the way of stop side 74 to allow table surface 5 to be lifted. (See FIG. 8)

Figure 13:
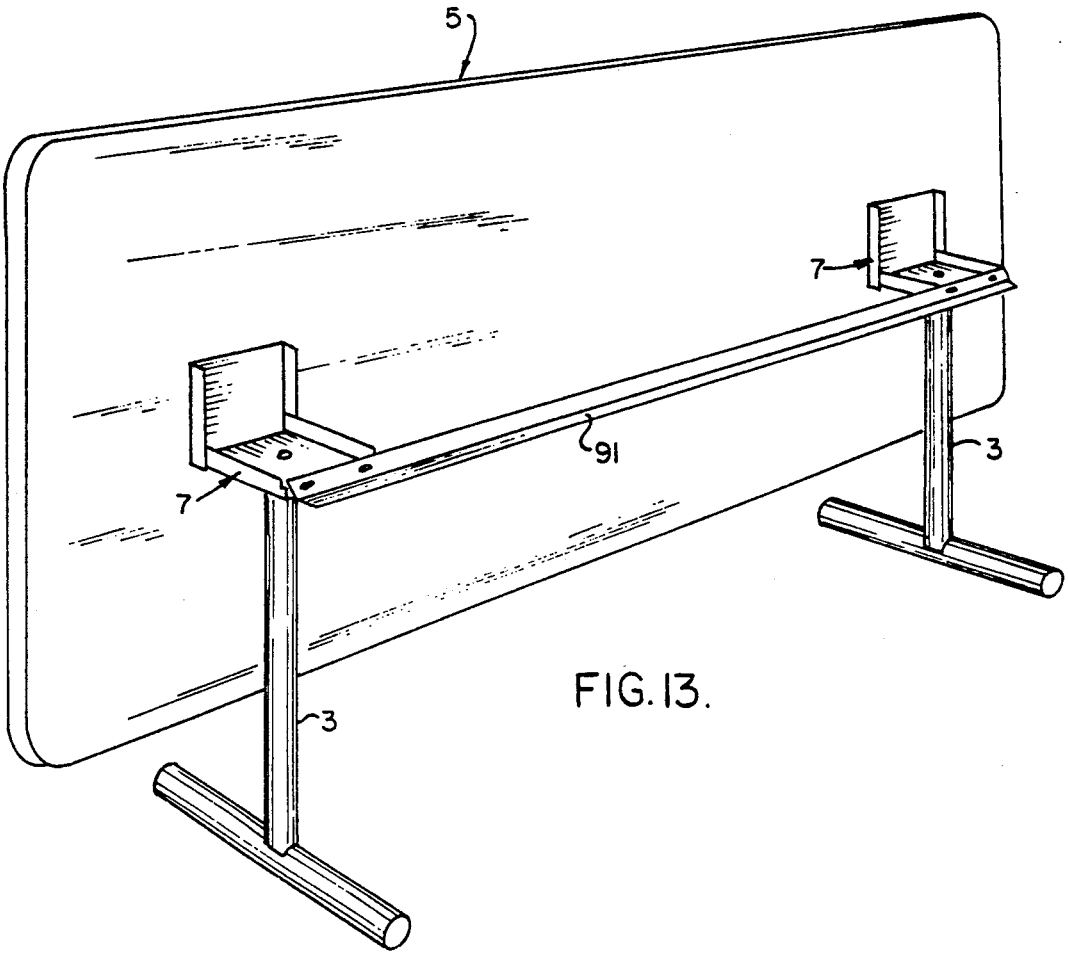
FIG. 13 is a perspective view of a long table employing a pair of the hinge mechanisms.

As shown in FIG. 13, the hinge mechanism 7 may also be used with an elongated table having two pedestal legs 3. In this embodiment the two hinges 7 are joined by a lengthened release bar 91. Release bar 91 is connected to cross members 45 of hinge latches 39. A single action will thus simultaneously affect release of both hinges at the same time so that the table top will be able to pivot at once. This one action facilitates unlocking of the table. Release bar 91 also simultaneously releases the hinge mechanisms 7 so that the table surface 5 may be raised without the need to release the hinges separately.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A flip top table including a table surface, pedestal means for supporting the table, and hinge means for hingedly connecting said table surface to said pedestal means so that said table surface can be moved between a vertical storage position and a horizontal use position, said hinge means comprising, a bottom plate connected to the top of said pedestal means, a top plate connected to the underside of said table surface, said top plate being pivotally connected to said bottom plate, means for locking said top and bottom plates together when said table surface is in said horizontal use position, means for releasing said locking means so that said table surface may be moved to said vertical storage position, catch means for maintaining said table surface in said vertical storage position, said catch means comprises an arm pivotally connected to said top plate to be generally parallel with said top plate when said table surface is in a vertical position, said arm extending between said top plate and said bottom plate and contacting said bottom plate to prevent said top plate, and hence said table surface, from pivoting towards said horizontal position when said table surface is in said vertical storage position.

2. The flip top table of claim 1 wherein said arm is pivotally connected to a finger extending from said top plate to hold said arm remote from said top plate.

3. A flip top table including a table surface, pedestal means for supporting the table, and hinge means for hingedly connecting said table surface to said pedestal means so that said table surface can be moved between a vertical storage position and a horizontal use position, said hinge means comprising, a bottom plate connected to the top of said pedestal means, a top plate connected to the underside of said table surface, said top plate being pivotally connected to said bottom plate, means for locking said top and bottom plates together when said table surface is in said horizontal use position, means for releasing aid locking means so that said table surface may be moved to said vertical storage position, catch means for maintaining said table surface in said vertical storage position, said top plate further including a longitudinally directed retaining means at a forward position thereof, wherein said locking means comprises a generally U-shaped bar having side legs and a cross member, said bar being pivotally connected to said bottom plate at said forward position, each said leg having a slot therein which receives a portion of said retaining means, said bar being biased to pivot inwardly towards a rear of said bottom plate, to normally maintain said locking means to said retaining means.

4. The flip-top table of claim 3 wherein said release means includes a tab on said cross member, wherein when said tab is pressed, said bar will pivot outwardly allowing said leg slots to release said retaining means.

5. The flip-top table of claim 4 wherein said tab is covered with a protective covering.

6. The flip-top table of claim 3 and said retaining means comprising an open-ended rectangular tube.

7. A flip-top table including a table surface, pedestal means for supporting the table, and hinge means for hingedly connecting said table surface to said pedestal means so that said table surface can be moved between a vertical storage position and horizontal use position, said hinge means comprising, a bottom plate connected to the top of said pedestal means, a top plate connected to the underside of said table surface, said top plate being pivotally connected to said bottom plate, means for locking said top and bottom plates together when said table surface is in said horizontal use position, means for releasing said locking means so that said table surface may be moved to said vertical storage position, catch means for maintaining said table surface in said vertical storage position, said hinge means further including means for placing said top and bottom plates in a generally parallel relationship when said table surface is placed in said horizontal position, said placing means comprising, side walls extending upwardly from said bottom plate, each said side wall including a step at a forward end thereof, said step defining a surface parallel and coplanar with, but below, the top of said side walls, and stop means on said upper plate, said stop means sitting on said step surface when said table surface is in said horizontal and usable position, said stop means being sized and shaped to place said top and bottom plates in said generally parallel relationship.

8. The flip-top table of claim 7 wherein said stop means comprises a formed open rectangular tube provided at a forward position of said upper plate and disposed for engagement by said locking means of the bottom plate.

* * * * *